United States Patent [19]

Ezawa et al.

[11] Patent Number: 4,512,230

[45] Date of Patent: Apr. 23, 1985

[54] ELECTRONIC MUSICAL INSTRUMENT

[75] Inventors: Sadaaki Ezawa; Hiroshi Kitagawa, both of Shizuoka, Japan

[73] Assignee: Kawai Musical Instrument Mfg. Co., Ltd., Hamamatsu, Japan

[21] Appl. No.: 488,289

[22] Filed: Apr. 25, 1983

[30] Foreign Application Priority Data

Apr. 26, 1982 [JP] Japan ..... 57-69970

[51] Int. Cl.[3] ..... G10H 1/02

[52] U.S. Cl. ..... 84/1.24; 84/345; 84/1.03

[58] Field of Search ..... 84/1.03, 1.24, 115, 84/345, 1.19, 1.28

[56] References Cited

U.S. PATENT DOCUMENTS 4,375,776 3/1983 Okamoto ..... 84/1.03

*Primary Examiner*—Forester W. Isen

*Attorney, Agent, or Firm*—Ralph Deutsch

[57] ABSTRACT

An electronic musical instrument has internal memories for storing various panel data and a detachable present circuit having external memories of high-speed operation for storing panel data equivalent to those of the internal memories, by which panel data can be set from the outside. An advanced player can adjust and set a wide variety of tone variations through using various panel data by the external preset circuit, and a beginner who does not require such various tone variations can set panel data by the internal memories alone.

2 Claims, 8 Drawing Figures

ELECTRONIC MUSICAL INSTRUMENT

BACKGROUND OF THE INVENTION

1. Field of the Invention

The present invention relates to an electronic musical instrument which has internal memories for storing various panel data by setting of tablet and volumes and, more particularly, to preset system which permits presetting of panel data from the outside of such an electronic musical instrument.

2. Description of the Prior Art

It is a general practice in the prior art, for presetting several kinds of tones in an electronic musical instrument, to incorporate therein devices of the same number as the tones to be set, for storing the set status of tablet and volumes mounted on the panel. But this conventional method is defective in that the number of tones to be set is fixed irrespective of the skill of each player. For example, when the number of tones to be preset is four, it is possible to preset a total of five kinds of tones, including one that is set on the panel. It must be noted, however, that the number of tone variations required for playing music widely differs with players. A beginner tends to devote himself to accurately playing keyboards rather than to change tones, and hence he is not likely to feel the necessity of tone variations. On the other hand, an advanced player can play the keyboards at will and is likely to get sick of playing with monotonous sounds peculiar to the electronic musical instrument. So, he will change tones one after another by controlling many tablets and volumes on the panel which are control means for producing various tones to emphasize the theme of the music being played. But these switches must be controlled during playing and simultaneous control of them is difficult for the player to do. It is impossible, in practice, to produce entirely different tone variations by such control operation on the panel alone; therefore, a preset unit is needed.

Incidentally, with a view to cutting down the manufacturing costs of the electronic musical instrument, the number of tones to be preset in the electronic musical instrument is usually selected sufficient for players of ordinary skill to play ordinary music. In some cases, however, an advanced player may be dissatisfied with the fixed number of preset tones. Especially, in the case of playing several musical selections in succession, the number of tone variations involved is so large that the fixed number of internally preset tones is entirely insufficient for him. Further, such presetting operation in the intermission of playing will be a heavy burden on the player. And for instance, inputing of erroneous data or occurrence of an error in the inputing operation will charge the player with another task.

Accordingly, it is desirable to both the player and an audience that presetting of tone variations be finished before playing. But the provision of many presetting means in the electronic musical instrument would increase its cost. In this case, an input unit, such as a magnetic card, tape or the like, is indispensable and its maintenance and cost greatly affect the overall costs of the electronic musical instrument, imposing a severe burden on the musical instrument maker. Moreover, this is economically disadvantageous to a large majority of users because they have to buy an expensive electronic musical instrument having incorporated therein equipment that they rarely use.

SUMMARY OF THE INVENTION

It is therefore an object of the present invention to provide an electronic musical instrument which is equipped with tone presetting functions sufficient for beginners and adapted so that many other presetting functions necessary for advanced players are provided in an external unit which can be connected with or disconnected from the electronic musical instrument as required.

Briefly stated, the electronic musical instrument of the present invention which has internal memories for storing various panel data by setting of tablet and volumes is provided with a plurality of external memories of high-speed operation for storing panel data equivalent to those of the internal memories, a plurality of control switches for controlling data transfer between the internal and the external memories, external control means for controlling write and read of the panel data for the external memories and delivering out a request signal for performing a transfer of the panel data between the internal and the external memories in accordance with setting of the control switches, and internal control means responsive to the request signal to control write and read of the panel data for the internal memories. The panel data can be set arbitrarily from the outside by the transfer of the panel data between the external and the internal memories.

According to the present invention, the electronic musical instrument which has the internal memories for storing various panel data is provided with a detachable preset circuit having the external memories so that panel data can be set from the outside. With the provision of the external preset circuit, an advanced player can adjust and set a wide variety of tones through utilization of various panel data. In the case of a beginner who does not require such various tone variations, the external preset circuit is disconnected from the electronic musical instrument. The panel data can then be set by using only the internal memories. In this way, it is possible to provide an electronic musical instrument to or from which the panel data setting part can be connected or disconnected according to the player.

DESCRIPTION OF THE PREFERRED EMBODIMENTS

Figure 1A:
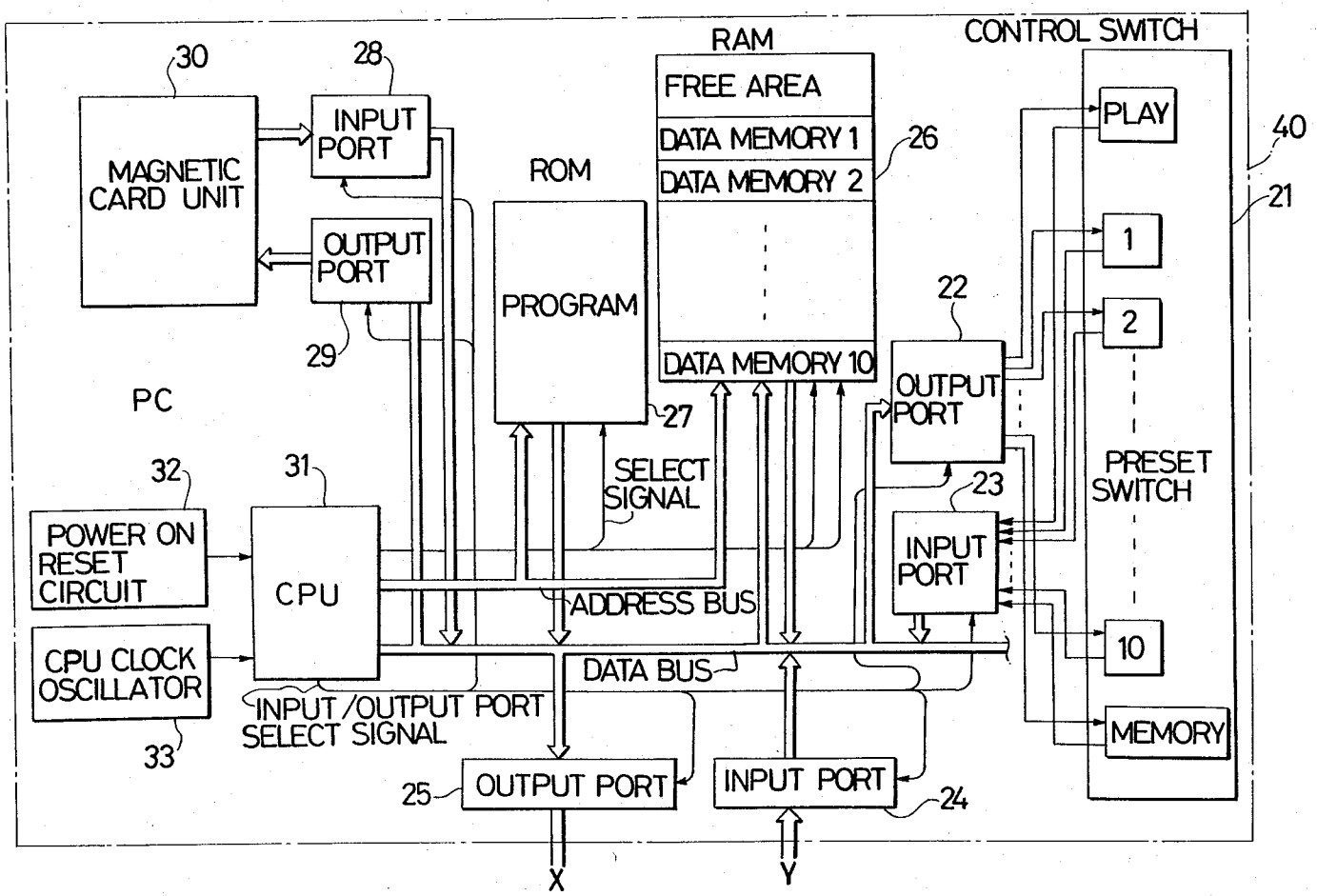
FIG. 1 is a block diagram illustrating the arrangement of an embodiment of the present invention.

FIG. 1 illustrates in block form the arrangement of an embodiment of the electronic musical instrument of the present invention. In FIG. 1, reference numeral 2 indicates generally a key detecting assignor KDA provided as an internal unit having a presetting function inside the electronic musical instrument; and 40 designates generally a preset circuit PC provided as an external unit similarly having a presetting function outside the electronic musical instrument. The key detecting assignor KDA 20 and the preset circuit PC 40 are each provided with a data processor (CPU). The key detecting assignor KDA 20 permits presetting of tones by setting tablet and volumes on the panel of the electronic musical instrument as usual. By connecting the preset circuit PC 40 to the key detecting assignor KDA 20, their presetting functions are combined, allowing an advanced player to play music with a wide variety of tones.

In the key detecting assignor KDA 20, data obtained by scanning a panel 1 is stored in a table (I)3. The table (I)3 has stored therein the status of the panel 1, for example, whether tablet switches (for vibrato, tremolo, clarinet, string, flute, etc.) are in the ON state, and the values of volumes (for sustain time control, amplitude control of draw bars, etc.). In contrast, a table (II)4 stores coefficients which are actually used for controlling tone productions on the basis of the values of the volume switches and such a data variation that when the tablet switch for string is ON, the tablet switch for vibrato is also ON automatically. Such processing is carried out by a data processor CPU 11; since this is not directly related to the present invention, no detailed description will be given.

The contents of the table (II)4 and the contents of a key switch memory 8 in which is stored information of a key detected to be ON as a result of scanning of a keyboard are controlled by a tone production controller 9, the output of which is applied to a speaker 10. In the tone production controller 9, a musical frequency is determined by the contents of the key switch memory 8 and the tone and volume of a musical sound are determined by the contents of the table (II)4. Such control is usually performed in ordinary electronic musical instruments.

In the preset circuit PC 40, a play switch [P], preset switches [1] to [10] and a memory switch [M] are provided as a preset switch array in a control switch 21 which is made up of switches, each having incorporated therein a non-lock type lamp. Data obtained by scanning the preset switch array is provided to a data processor CPU 31 via an input port 23 and a data bus. An output port 22 performs ON-OFF control of the lamps. The ON state of the lamps indicating that the switches are in operation and the OFF state indicating that the switches are out of operation are controlled by the data processor CPU 31 via the data bus.

In the data processor CPU 31, registers, a program counter and so forth are reset, for instance, by a power ON reset circuit 32 which carries out the resetting through utilization of a period in which a power source charges a capacitor via a resistor, and a clock is provided by a CPU clock oscillator 33 and, on the basis of a program stored in a ROM 27, data is read out from or written in a RAM 26 at a location specified by an address from the data processor CPU 31. Further, read/-write of a magnetic card unit 30 is also carried out via an input port 28 and an output port 29 under the control of the data processor CPU 31. The data of the RAM 26 and the data of the magnetic card unit 30 by selective 0N-OFF control of the control switches 21 are provided via an input port 24 and an output port 25 of the preset circuit PC 40 to an output port 7 and an input port 6 of the key detecting assignor KDA 40. Incidentally, these input and output ports are selectively controlled by programs of the data processors CPU 11 and 31 of the preset circuit PC 40 and the key detecting assignor KDA 20 to which they belong.

The table (II)4 of the key detecting assignor KDA 20 is controlled by the preset circuit PC 40 via the above mentioned input and output ports. The highest priority of the exclusive use of the table (II)4 is given to presetting of the preset circuit PC 40, the second is presetting of the key detecting assignor KDA 20 and the third is setting on the panel 1 of the key detecting assignor KDA 20.

This will be described in an ascending order of the priority. As described previously, the result of scanning of the panel 1 of the key detecting assignor KDA 20 of the third priority is stored in the table (I)3, on the basis of which data for controlling tone production is stored in the table (II)4, and tone productions are carried out in accordance with the contents set on the panel 1.

In the case of the presetting of the key detecting assignor KDA 20 of the second priority, if the presetting changes changes from OFF to ON as a result of scanning of the panel 1, the data of the table (II)4 is saved into a table (III)5 and contents of data memories $2_1$ to $2_3$ corresponding to the presetting are stored in the table (II)4, controlling the tone production. In the data memories $2_1$ to $2_3$, if a tablet switch [1] on the panel 1 is set to correspond to a string orchestra, data for producing a feeling of a string orchestra is preset by a combination of tablet switches in the data memory $2_1$. The data memories $2_1$ to $2_3$ may be fixed ones using ROM's, or they may also be variable ones using RAM's like data memory $2_3$ which store desired contents of the Table (II)4. When the presetting changes from ON to OFF afterwards as result of scanning of the panel 1, the data saved in the Table (III)5 is brought back to the table (II)4, performing again the tone production initially set on the panel 1. By the way, when the presetting is ON, no control on the panel 1 is effective. The above processing is also carried out by the data processor CPU 11; but no detailed description will be given.

In the case of presetting of the preset circuit PC 40 to the highest priority, when one of the switches [1] to [10] is lighted and the play switch [P] indicating the top priority of the preset circuit PC 40 is lighted, the contents of corresponding data memories 1 to 10 are stored in the table (II)4, by which tone production is controlled. At this time, if data of the third priority is stored in the table (II)4, then the data is saved into the table (III)5. When the data of the second priority has been stored, it is not saved but destroyed. When the lighted one of the preset switches [1] to [10] is turned OFF or the play switch [P] is turned OFF, the priority of the preset circuit PC 40 is lost.

And if the data of the third priority has been prestored in the table (II)4, the data in the table (III)5 is returned to the table (II)4, performing the initial tone production set on the panel 1. In the case where the data of the second priority has been stored, the contents of the corresponding data memories $2_1$ to $2_3$ are stored again in the table (II)4, carrying out tone production. When the preset circuit PC 40 has the top priority, no control on the panel 1 is effective.

The abovesaid processing is carried out by the data processor CPU 11; but no detailed description will be given.

Furthermore, the data of the table (II)4 may also be transferred to the preset circuit PC 40 in some cases.

The memory switch [M] of the control switch 21 of the preset circuit PC 40 is lighted in the case of requesting a data transfer from the key detecting assignor KDA 20 to the preset circuit PC 40 or writing data in a card. For this, there are two cases where any one of the preset switches [1] to [10] and the memory switch [M] are turned ON and then the memory switch [M] is turned OFF and then the data of the table (II)4 is transferred to the corresponding data memory and where the memory switch [M] is tuned ON with all the preset switches held OFF and then the data of the table (II)4 is written in the card. At this time, the data of the table (II)4 is once transferred to a buffer memory (I) in a free area of the RAM 26 of the preset circuit PC 40. If the card is operated when the memory switch [M] is OFF, then a readout operation takes place and read out data is stored in a data memory corresponding to a lighted one of the preset switches [1] to [10]. The data transmission and reception between the preset circuit PC 40 and the key detecting assignor KDA 20 are executed via the input port 6 and the output port 7 on the side of the key detecting assignor KDA 20 and the input port 24 and the output port 25 on the side of the preset circuit PC 40. Tables 1 and 2 show signals that are used therefor.

TABLE 1

| | BS | | |
|---|---|---|---|
| Output port on the side of KDA | KAD | ANS | Input port on the side of PC |
| | data | IN3 | |
| | data | IN2 | |
| | data | IN1 | |
| | data | IN0 | |

TABLE 2

| Input port on the side of KDA | PC → KDA<br>PC ← KDA<br>PLY | | Output port on the side of PC |
|---|---|---|---|
| | PC | ANS | |
| | data | OUT3 | |
| | data | OUT2 | |
| | data | OUT1 | |
| | data | OUT0 | |

The functions of the signals are as follows: BS: A flag for the data processor CPU of the key detecting assignor KDA to input a signal from the preset circuit PC via the input port. When the flag is a "1", the data processor inputs the signal and processes a request from the preset circuit PC. If the flag is a "0", the data processor does not input the signal and performs processing of the key detecting assignor KDA itself.

KDA ANS: A flag which goes to a "1" when the key detecting assignor KDA delivers out data or receives data.

Data IN0 to 3: Data which are used when data is transferred from the key detecting assignor KDA to the preset circuit PC. These data are input into the preset circuit PC.

PC ANS: A flag which goes to a "1" when the preset circuit delivers out or receives data.

Data OUT0 to 3: Data which are used when data is transferred from the preset circuit PC to the key detecting assignor KDA. These data are output from the preset circuit PC.

PC→KDA: A flag which goes to a "1" when requesting a data transfer from the preset circuit PC to the key detecting assignor KDA.

PC←KDA: A flag which goes to a "1" when requesting a data transfer from the key detecting assignor KDA to the preset circuit PC.

PLY: A flag which goes to a "1" when the preset circuit PC has the top priority. This flag goes to a "1" when the play switch [P] and any one of the preset switches [1] to [10] are turned ON.

Figure 1B:
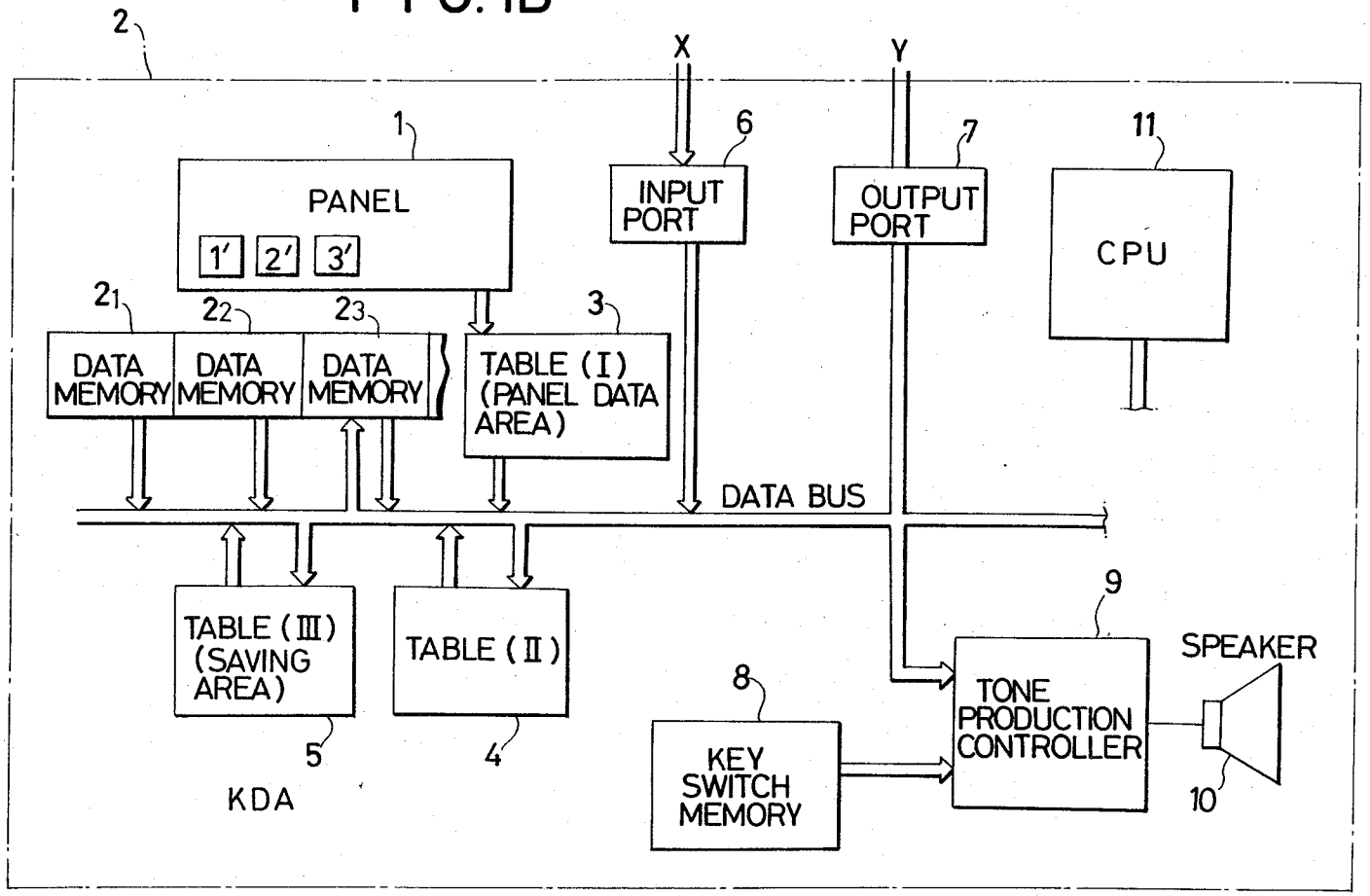
Figure 2:
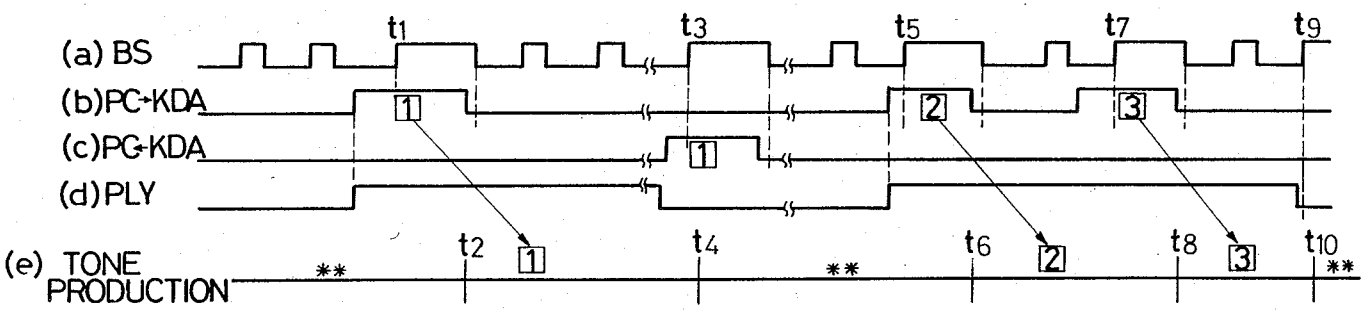
FIGS. 2(*a*) to (*e*) show basic operating waveforms in the embodiment of FIG. 1.

FIGS. 2(*a*) to (*e*) show basic operating waveforms for data transmission and reception between the key detecting assignor KDA and the preset circuit PC in FIG. 1. In the intervals of processing of its own, the key detecting assignor KDA 20 makes the flag BS a "1" to decide the request from the preset circuit PC. When it is detected that the flag PC→KDA of FIG. 2(*b*) is a "1" corresponding to the time $t_1$ of the flag BS of FIG. 2(*a*), data of the data memory 1 corresponding to the preset switch [1] is transferred to the table (II)4 and a tone production [1] is performed, starting at the time $t_2$ as shown in FIG. 2(*e*). Next, when it is detected that the flag PC←KDA of FIG. 2(*c*) is "1" at the time $t_3$ of the flag BS of FIG. 2(*a*), the data of the table (II)4 is transferred to the data memory 1 of the RAM 26 of the preset circuit PC 40 and, at the same time, it is detected that the flag PLY of FIG. 2(*d*) is a "0" and a tone production (indicated by ) set on the panel 1 is started at the time $t_4$. Then it is detected that the flag PC→KDA of FIG. 2**(*b*) is a "1" at the time $t_5$ of the flag BS of FIG. 2(*a*) and a data transfer from the data memory 2 is executed, starting a tone production [2] at the time $t_6$ as shown in FIG. 2(*e*). Similarly, it is detected that the flag PC→KDA is a "1" at the time $t_7$ and a data transfer from the data memory 3 is executed, starting a tone production [3] at the time $t_8$. At the time $t_9$ it is detected that the flag PLY is a "0" and a tone production set on the panel 1 is started at the time $t_{10}$. As described above, data is transferred only once when the flag PC→KDA or PC←KDA goes to a "1". And it is determined by the flag PLY whether the preset circuit PC has the highest priority. When the data transfer occurs, the period during which the flag BS is at "1" is naturally long.

Figure 3A:
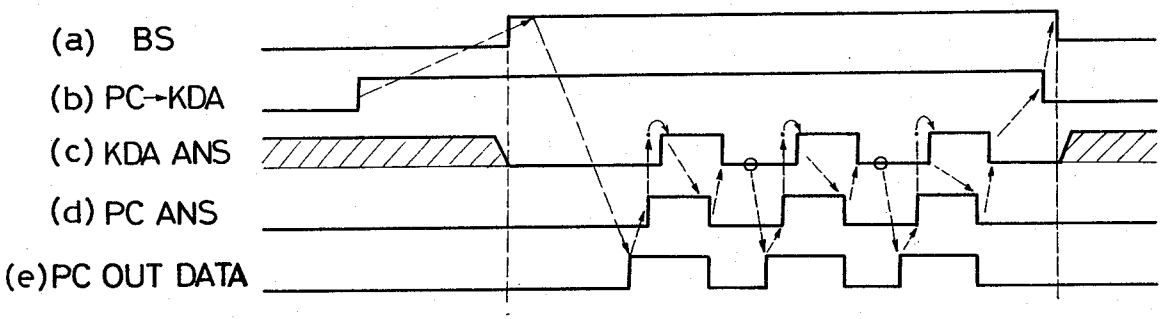
FIGS. 3A (*a*) to (*e*) and 3B (*a*) to (*e*) show more detailed operating waveforms.
Figure 4A:
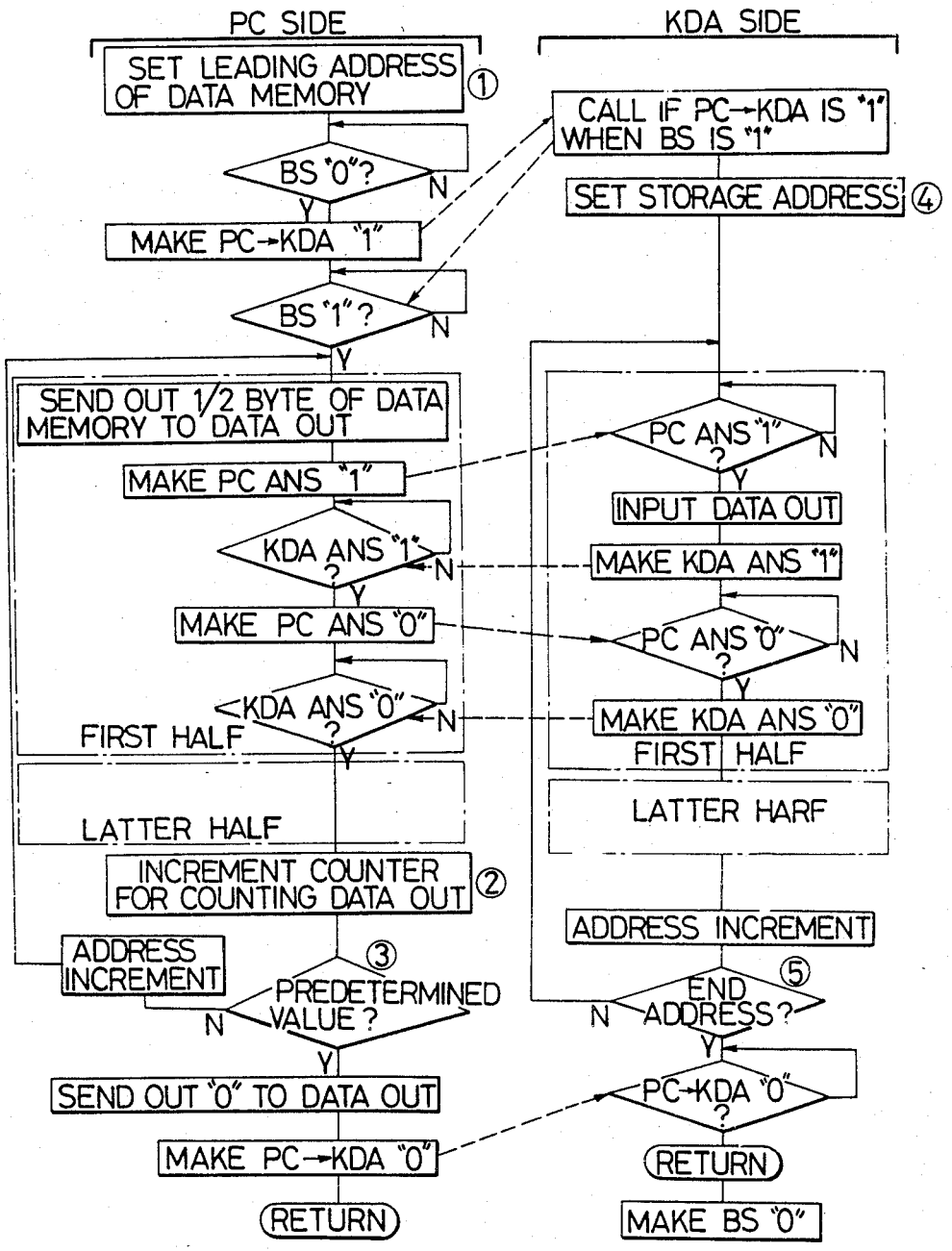
FIGS. 4A and 4B are flowcharts respectively corresponding to FIGS. 3A and 3B.
Figure 4B:
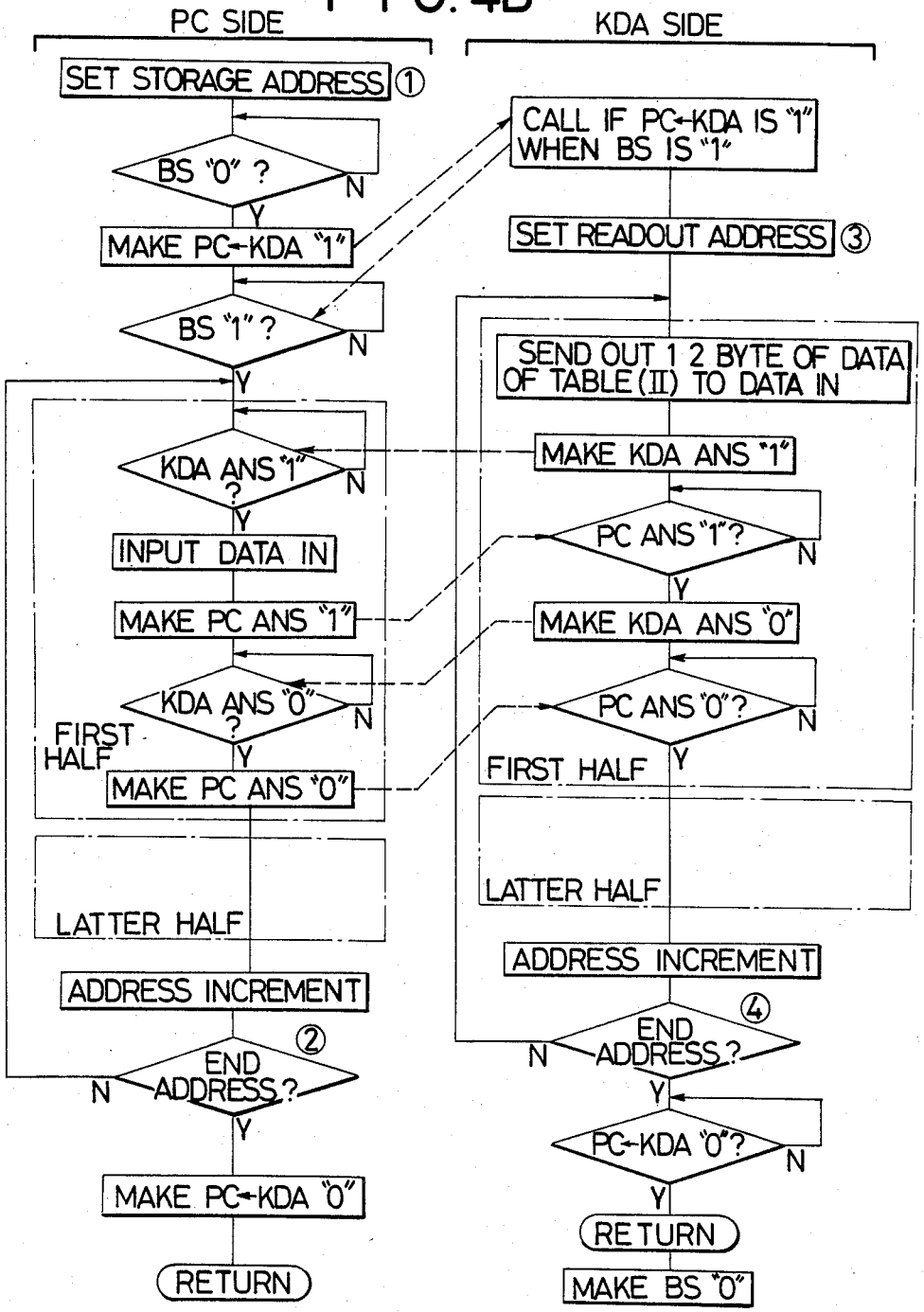

FIGS. 3A (*a*) to (*e*) and 3B (*a*) to (*e*) are operating waveform diagrams showing the data transfer between the preset circuit PC 40 and the key detecting assignor KDA 20, and FIGS. 4A and 4B are flowcharts showing the data transfer operation.

Figure 3B:
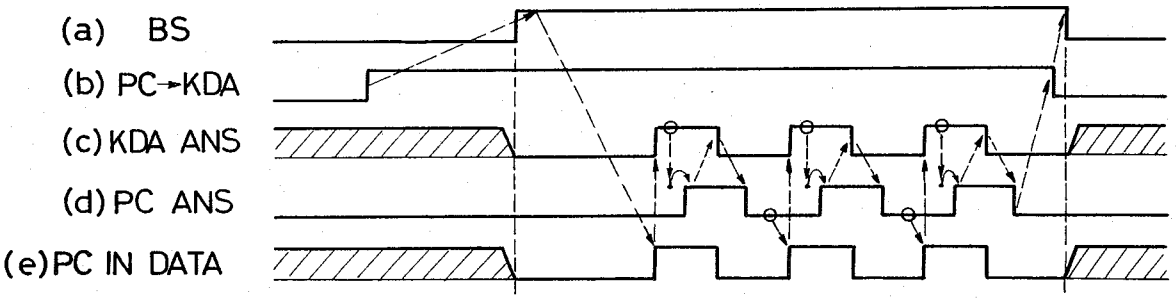

In FIGS. 3A and 3B the number of data output/input operations are three for convenience of description but, in practice, the number of such operations is larger.

FIG. 3A shows the data transfer from the preset circuit PC to the key detecting assignor KDA. When it is detected that the flag BS of FIG. 3A (*a*) which is input into the input port goes to a "1", it is recognized in the key detecting assignor KDA 20 that the flag PC→KDA is at "1" and a data transfer mode PC→KDA is initiated. The preset circuit PC 40 sends data OUT0 to OUT3 (shown Table 2) to the output port as shown by PC OUT data of FIG. 3A (*e*) and makes the flag PC ANS of FIG. 3A (*d*) a "1". Recognizing that the flag PC ANS has gone to a "1", the key detecting assignor KDA 20 receives the data and makes the flag KDA ANS of FIG. 3A (*c*) a "1". Based on the recognition that the flag KDA ANS has gone to a "1", the flag PC ANS goes to a "0" and, based on the recognition that the flag PC ANS has gone to a "0", the flag KDA ANS goes to a "0" and the next data OUT0 to OUT3 are sent to the output port as shown by the PC OUT data of FIG. 3A (*e*). Upon completion of the data transfer after repeating the above operation, the flag PC→KDA of FIG. 3A (*b*) is made a "0". Recognizing that the flag PC→KDA has gone to a "0", the key detecting assignor KDA 20 put an end to the data transfer mode PC→KDA and makes the flag BS of FIG. 3A (*a*) to "0".

FIG. 3B shows the data transfer from the key detecting assignor KDA to the preset circuit PC. When it is detected that the flag BS of FIG. 3B (*a*) goes to a "1", it is recognized in the key detecting assignor KDA that the flag PC←KDA has gone to a "1" and a data transfer mode PC←KDA is initiated. The key detecting assignor KDA 20 sends data IN0 to IN3 (shown Table 1) to the output port as indicated by PC IN data of FIG. 3B (*e*) and makes the flag KDA ANS of FIG. 3B (*c*) a "1". Recognizing that the flag KDA ANS has gone to a "1", the preset circuit PC 40 receives the data and makes the flag PC ANS of FIG. 3B (*d*) a "1". Based on the recognition that the flag PC ANS has gone to a "1", the flag KDA ANS of FIG. 3B (*c*) goes to a "0" and, based on the recognition that the flag KDA ANS has gone to a "0", the flag PC ANS goes to a "0" and the next data IN is delivered out to the input port as indicated by PC IN data of FIG. 3B (*e*). Upon completion of the data transfer after repeating the abovesaid operation, the flag PC←KDA of FIG. 3B (*b*) is made a "0". Recognizing that the flag PC←KDA has gone to a "0", the key detecting assignor KDA 20 completes the data transfer mode PC←KDA and makes the flag BS of FIG. 3B (*a*) a "0".

FIGS. 4A and 4B are flowcharts corresponding to FIGS. 3A and 3B, respectively, and follow the procedures described above. An additional description will be given of steps indicated by numerals in circles. Incidentally, the broken lines joining some of the steps on both side of the preset circuit PC and the key detecting assignor KDA show that these steps are carried out in association with each other.

In FIG. 4A, in step ① is set the leading address of that data memory of the data memories 1 to 10 of the RAM 26 in the preset circuit PC from which data is to be delivered out. Since the data OUT0 to OUT3 each have a four-bit configuration, one-byte data is sent out in two stages. In step ②, a counter for counting how many bytes of data have been delivered is incremented. In step ③, it is decided whether the count value of the counter has reached a predetermined value as a result of the increment. In step ① is used the content of the leading address of that one of the preset data memories of the RAM 26 in the preset circuit PC 40 which is of a specified address and has its lamp lighted. As this content is stored the content of the leading address of that one of the data memories which is always lighted in the preprocessing of this flowchart. In step ③, since the data memories 1 to 10 of the RAM 26 in the preset circuit PC 40 each consist of 64 bytes, if the count value of the counter is 65-byte after it is incremented, it is decided that the counter has reached the predetermined value. In step ④ is set the leading address of the table (II)4 in FIG. 1B. Since the data OUT0 to OUT3 each are input by steps of four bits corresponding to the side of the preset circuit PC 40, one-byte data is input in two stages. In step 5 it is decided whether the address has become an end address. When a end address of the table (II)4 has passed, it is decided that the end address has been reached.

In FIG. 4B, input data is stored in a buffer memory (I) in the free area of the RAM 26 in the preset circuit PC 40. In Step ① this specified address is set as a storage address. Since the data IN0 to IN3 each have a four-bit configuration, one-byte data is input in two stages. In step ② it is decided whether data of a required number has been input. When a last address of the buffer memory (I) of the RAM 26 in the preset circuit PC 40 has passed, it is decided that an end address has been reached. In step ③ the leading address of the table (II)4 of the key detecting assignor 20 in FIG. 1B is set. Since the data is delivered to the data IN0 to IN3 by steps of four bits corresponding to the side of the preset circuit PC, one-byte data is sent out in two stages. In step ④ it is decided that the end address has been reached. When the last address of the table (II)4 has been passed, it is decided that the end address has been reached.

Next, a detailed description will be given of the RAM 26 in the preset circuit PC 40 in FIG. 1A which forms the principal part of the present invention. The arrangement of the RAM 26 can be roughly divided into the free area and the data memory as described previously. The free area comprises buffer memories (I) to (III), a status memory area and a stack pointer storage area. The data memory is made up of the data memories 1 to 10 corresponding to the preset switches. The function of each part is as follows:

(I) Buffer memory (I)

This performs the function of a buffer in the data transmission and reception between the preset circuit PC 40 and the key detecting assignor KDA 20. Accordingly, the format of this buffer memory agrees with the format of each of the data memories 1 to 10 and each table of the key detecting assignor KDA 20. The format consists of digital data (indicating the ON-OFF state of the tablet switches) and analog data (indicating the state of the volumes).

(II) Buffer memory (II)

The format of this buffer memory agrees with the record format of the card which is used with the magnetic card unit 30 in the preset circuit PC 40. This format also consists of digital data and analog data but it is a little modified as will be described later. The card has, for example, two recording zones, each having a recording capacity of about 28 bytes (224 bits). And the card has what is called an approach section for stabilizing its running which is often unstable after insertion into the magnetic card unit, owing to trembling of the operator's hand, distortion of the card itself or the like. In the tow recording zones are recorded digital data and analog data separately of each other. The data are recorded serially, bit by bit, from the right to the left for each byte. The data is read out, bit by bit, from the right to the left after detecting a bit pattern "101" in the approach section. The data thus read out is once stored in the buffer memory (III) common to the two recording zones, that is, common to the digital and the analog data and transferred to the buffer memory (II) after it is decided whether the data is digital or analog. This removes the restriction which one of the digital and the analog data be read out first from the card. The digital data thus read out is held in the format of the buffer memory (I) but the analog data has such a format that five high-order bits of each byte (made to correspond to one byte=one volume) of the buffer memory (I) have been rearranged. This restriction is unnecessary, of course, when the recording capacity of the card is sufficient.

(III) Buffer memory (II)

As described above, the data read out from the magnetic card is once stored in this buffer memory.

(IV) Status memory area

In this area lamp control and switch control take place. The lamp control is to control lighting of lamps incorporated in the switches of the non-lock type control switch 21. When the bits of the output port 22 in the preset circuit PC 40 corresponding to the control switch 21 are at "1s", the lamps of the corresponding switches are turned ON and if the bits are at "0s", the lamps of the corresponding switches are turned OFF. The lighting of the lamp indicates, instead of a mechanical locked state, that the switch is in operation. The switch status indicates the mechanical ON/OFF state of the switch. The depression of the switch that provides a "1" corresponds to the ON state and the release of the switch that provides a "0" corresponds to the OFF state. Furthermore, WP (Write Protection) of a microswitch output of the magnetic card unit and STR (card start) control are carried out. When an output STR among microswitch outputs of the magnetic card unit changes from the "0" state to the "1" state, the insertion of the card is detected and when the output STR changes from the "1" state to the "0" state, the withdrawal of the card is detected. The outputs WR and STR are each provided with a microswitch. When an unwritable card having its oned end cut off is inserted, the microswitch output WP remains at "0" and write is inhibited and only the microswitch output STR goes to a "1".

Figure 5:
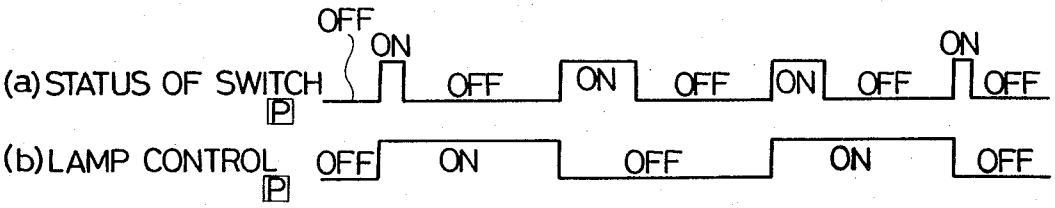
FIGS. 5(*a*) and (*b*) are diagrams explanatory of the operation of a principal part of the embodiment of FIG. 1.

FIGS. 5(*a*) and (*b*) show the relationship between the status of the play switch P of the control switch 21 in the preset circuit PC 40 (in FIG. 5(*a*)) and the lamp control (in FIG. 5(*b*)). That is to say, it is shown that a change is caused by an event of rise but that no change is caused by an event of fall.

(V) Stack pointer storage area

This is used for storing a stack pointer of the data processor CPU 31 of the preset circuit PC 40.

(VI) Data memories 1 to 10 corresponding to the preset switches

The data memories 1 to 10 each consists of 64 bytes and their formats agree with the formats of the buffer memory (I) and each table of the key detecting assignor KDA 20.

As has been described in the foregoing, according to the present invention, the electronic musical instrument which has internal memories is provided with a detachable preset circuit having external memories so that panel data can be set from the outside of the electronic nmusical instrument. With the use of the external preset circuit, an advanced player can adjust and set a wide variety of tones through utilization of various panel data. In the case of a beginner who does not require such various tone variations, the external preset circuit is disconnected from the electronic musical instrument and panel data by the internal memories alone can be set. In this way, it is possible to provide an electronic musical instrument to or from which the panel data setting part can be connected or disconnected according to the player.

It will be apparent that many modifications and variations may be effected without departing from the scope of the novel concepts of the present invention.

What is claimed is:

1. In combination with an electronic musical instrument having a plurality of panel tone control switches and having a plurality of internal memories each of which stores the switch states of a setting of said plurality of panel tone control switches, apparatus for externally augmenting the number of said plurality of internal memories comprising;

a plurality of external memories each of which stores the switch states of a setting of said plurality of panel tone control switches, a panel memory means for storing the switch states of said plurality of panel tone control switches, a plurality of internal preset switches each of which corresponds to one of said plurality of internal memories, an internal memory read means responsive to the actuation of said plurality of internal preset switches whereby the contents of an internal memory corresponding to an actuated internal preset switch is read into said panel memory means, a plurality of external preset switches each of which corresponds to one of said plurality of external memories, a play switch means for generating a request signal, an external memory switch means for generating an external memory write signal, an external memory write means responsive to the actuation of said plurality of external preset switches whereby the contents of said panel memory means is stored into one of said plurality of external memories corresponding to an actuated external preset switch if said external memory write signal is generated, a card reader means for reading data from a memory card in response to a card read signal and for storing data in a memory card in response to a card write signal, a memory transfer means responsive to the actuation of said plurality of external preset switches whereby in response to said card read signal the data read from said memory card is stored in one of said plurality of external memories corresponding to an actuated external preset switch and whereby in response to said card write signal the data stored in one of said plurality of external memories corresponding to an actuated external preset switch is stored in said memory card, an external memory read means responsive to the actuation of said plurality of external preset switches whereby the contents of an external memory corresponding to an actuated external preset switch is read into said panel memory means if said request signal is generated, and utilization means responsive to the data stored in said panel memory means whereby musical tones are generated corresponding to the stored set of switch states for a setting of said plurality of panel tone control switches.

2. In combination with an electronic musical instrument having a plurality of panel tone control switches and having a plurality of internal memories each of which stores the switch states of a setting of said plurality of panel tone control switches, apparatus for externally augmenting the number of said plurality of internal memories comprising;

a plurality of external memories each of which stores the switch states of a setting of said plurality of panel tone control switches, a tone parameter memory means for storing a set of tone generation parameter data values, a plurality of internal preset switches each of which corresponds to one of said plurality of internal memories, an internal memory read means responsive to the actuation of said plurality of internal preset switches whereby the contents of an internal memory corresponding to an actuated internal preset switch is read out, a plurality of external preset switches each of which corresponds to one of said plurality of external memories, a play switch means for generating a request signal, an external memory read means responsive to the actuation of said plurality of external preset switches whereby the contents of an external memory corresponding to an actuated external preset switch is read out, a selection memory means for storing data read out from an external memory by said external memory read means if said request signal is generated or for storing data read out from an internal memory by said internal memory read means if said request signal is not generated, a parameter select means responsive to data stored in said selection memory means whereby a selection of said set of tone generation parameter data is read out of said tone parameter memory means, and utilization means responsive to said selection of a set of tone generation parameters read out of said tone parameter memory means by said parameter select means whereby musical tones are generated corresponding to the stored set of switch states for a setting of said plurality of panel tone control switches.

* * * * *